United States Patent [19]

Arakaki

[11] Patent Number: 4,830,245

[45] Date of Patent: May 16, 1989

[54] BACKPACK CARRIER AND SHIELD

[76] Inventor: Steven Y. Arakaki, 927 Laki Rd., Honolulu, Hi. 96817

[21] Appl. No.: 164,757

[22] Filed: Mar. 7, 1988

Related U.S. Application Data

[63] Continuation of Ser. No. 941,342, Dec. 15, 1986, abandoned.

[51] Int. Cl.[4] ..... A45F 3/08

[52] U.S. Cl. ..... 224/210; 224/153; 224/907; 2/2.5; 428/911

[58] Field of Search ..... 224/907, 213, 210, 209, 224/261, 153, 213, 215, 211, 212, 214, 216, 225; 2/2.5; 428/911

[56] References Cited

U.S. PATENT DOCUMENTS

| | | | |
|---|---|---|---|
| 660,716 | 10/1900 | Anderson | 428/911 |
| 1,294,191 | 2/1919 | Suderlock | 428/911 |
| 2,421,244 | 5/1947 | Daiber | 224/210 X |
| 2,667,996 | 2/1954 | Fanelli | 224/153 |
| 3,980,216 | 9/1976 | Nye | 224/209 |
| 4,088,252 | 9/1978 | Grunberger | 224/210 |
| 4,135,654 | 1/1979 | Chu | 224/261 |
| 4,213,549 | 7/1980 | Hibbard | 224/209 |
| 4,431,121 | 2/1984 | Bensette | 224/261 X |
| 4,507,802 | 4/1985 | Small | 2/2.5 |
| 4,522,871 | 6/1985 | Armellino, Jr. et al. | 2/2.5 X |

FOREIGN PATENT DOCUMENTS

| | | | |
|---|---|---|---|
| 684040 | 11/1939 | Fed. Rep. of Germany | 224/261 |
| 2754061 | 6/1979 | Fed. Rep. of Germany | 224/907 |
| 1012812 | 7/1952 | France | 224/210 |
| 43632 | 1/1927 | Norway | 224/261 |

*Primary Examiner*—Henry J. Recla
*Assistant Examiner*—Linda J. Sholl
*Attorney, Agent, or Firm*—James Creighton Wray

[57] ABSTRACT

A backpack carrier has a lightweight metal frame embedded in KEVLAR. The KEVLAR is preferably wrapped to form a plurality of layers over the metal frame and the plural layers are held together by the epoxy portion of the KEVLAR which integrally binds laminations of woven carbon-based fabric. The carrier is shaped to provide a substantially bulletproof shield and may also be used as a rifle support by placing the barrel of a rifle in a V-shaped notch provided in an upper portion of the shield.

17 Claims, 2 Drawing Sheets

FIG. 1
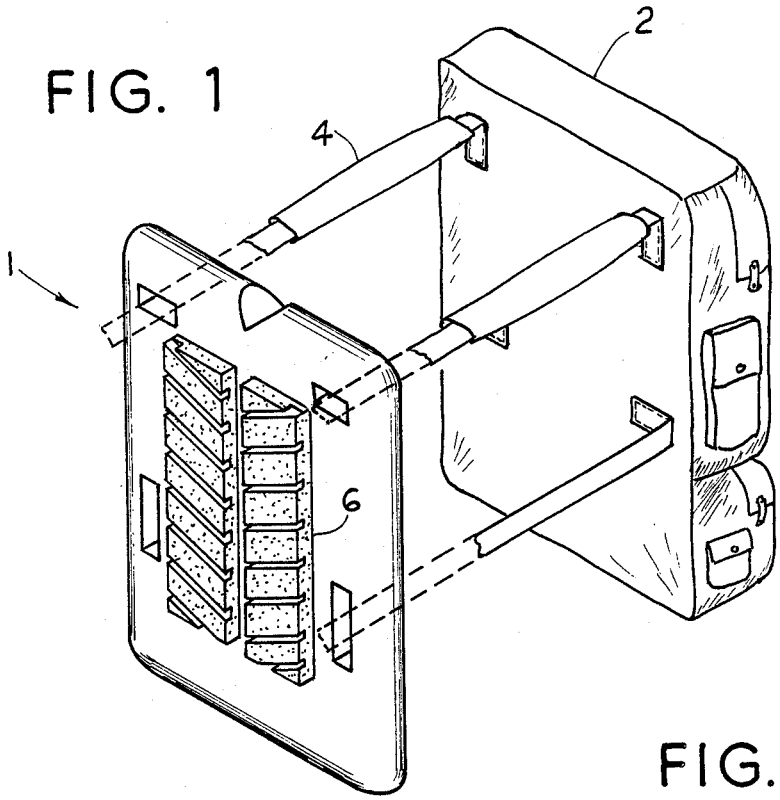
FIG. 3
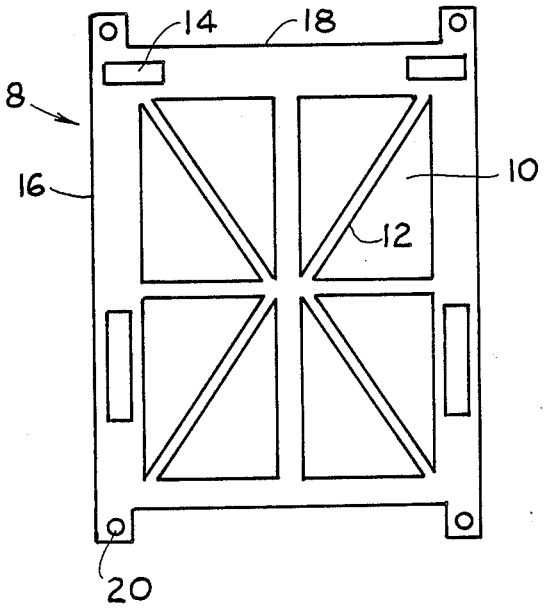
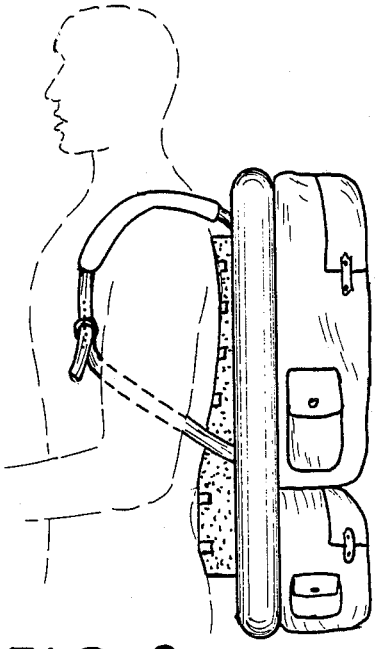
FIG. 2
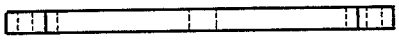
FIG. 4

FIG. 5
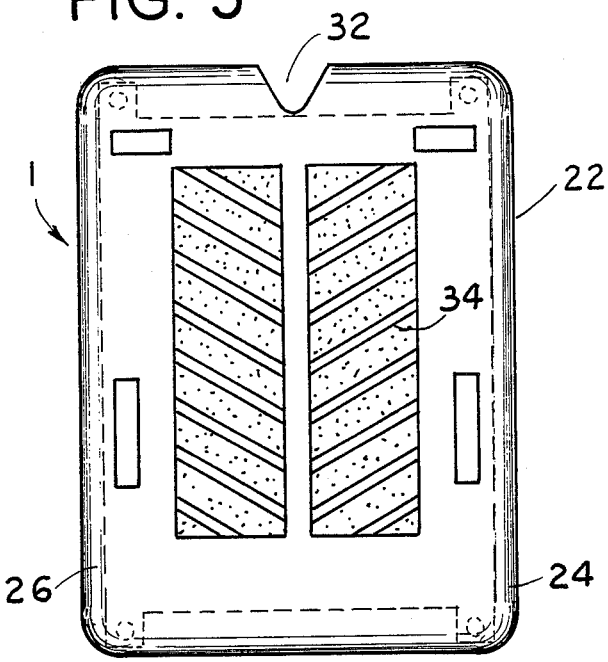
FIG. 6
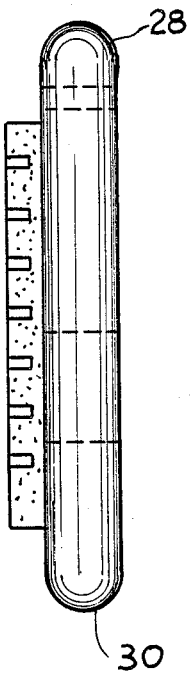
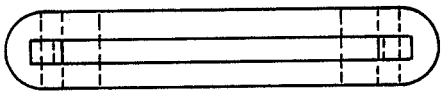
FIG. 8
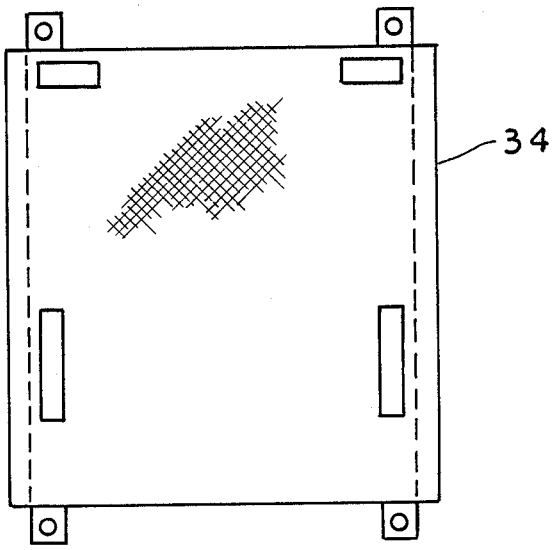
FIG. 7
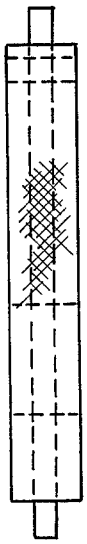
FIG. 9

BACKPACK CARRIER AND SHIELD

This application is a continuation of application Ser. No. 941,342, filed Dec. 15, 1986.

BACKGROUND OF THE INVENTION

Backpack frames are generally known and usually consist of tubular aluminum segments which form a rectangular support for carrying a backpack and related camping or military implements.

The known backpack frames provide comfort for the user of the frame but are not intended to provide protection from bullets.

Bulletproof shields have not been widely accepted for military use. The reasons may be associated with the high weight and cumbersome nature of prior art shields. Prior art shields represent an additional implement which must be carried by the foot soldier.

Kevlar Aramid Fiber materials are known for their high strength and low weight and have in the past been used for ballistic materials for flexible body armor.

U.S. Pat. No. 4,522,871 teaches the use of a KEVLAR material for making flexible body armor.

U.S. Pat. No. 4,510,200 teaches bulletproof fabric made of KEVLAR.

No one in the past has taught or suggested the use of KEVLAR in making a backpack carrier which serves the dual purpose of carrying a backpack and deflecting or stopping bullets fired at a soldier.

The combined backpack carrier and bulletproof shield solves many of the problems associated with the prior art.

SUMMARY OF THE INVENTION

The present invention uniquely solves many of the problems associated with the prior art by making a backpack carrier which is light enough to carry but strong enough to stop or deflect bullets.

The present invention provides a carrier that is substantially rectangular in shape with four slots for straps to pass through. One side of the carrier is provided with foam rubber strips which are intended to conform to the user's back to provide comfort and support.

An upper surface of the carrier is provided with a V-shaped notch for receiving a rifle barrel in the event that the carrier is used as a brace to steady the rifle.

The carrier has a skeletal frame which is made of light-weight metal or metal alloys, such as titanium or aluminum. Titanium or aluminum is preferred for its light weight and high strength properties. Both materials have sufficient rigidity to withstand flexing and strength to withstand repeated hits from bullets. The rigidity of the frame also imparts an overall stiffness to the carrier.

The skeletal frame could be either stamped or forged to the desired shape. In order to keep weight at a minimum, triangular sections are removed from the frame. Also, each corner of the frame is provided with alignment holes used during the wrapping of the KEVLAR material, which will be described later.

The thickness of the metal or metal alloy used in the skeletal frame would be approximately ¼ of an inch. Titanium has a density of 0.163 pounds per cubic inch and therefore a plate 12 inches by 12 inches by 0.25 inch would weigh 5.868 pounds.

Aluminum has a density of about 0.1 pounds per cubic inch and for the same size plate the aluminum would weigh 3.6 pounds. Although either metal could be used, the exact choice would depend on the specific strength and weight requirements of the backpack carrier.

Titanium, in its commercially pure state, contains 99.2% titanium and 0.2% lead. The titanium is annealed and has a tensile strength of 63 ksi, a yield strength of 50 ksi, and a Charpy impact strength of 32 foot pounds.

Aluminum, on the other hand, in the wrought alloy state, has a tensile strength of 68 ksi and a yield strength of 47 ksi. The Charpy impact strength is less than that of titanium.

The preferred wrapping material which is wrapped around the metal or metal alloy frame is KEVLAR which is commercially available from the duPont Chemical Company. KEVLAR consists of woven Aramid fibers. The woven fibers are mixed with epoxy to form a composite that has very high tensile strength and low weight.

KEVLAR is available through the duPont Chemical Company which sells two types of fabric which are particularly suitable for the present invention, ARAMID 29 and ARAMID 49. The products consist of aromatic polyamides. ARAMID 29 is preferable and can be mixed with any suitable epoxy.

The aromatic polyamide fiber is woven into a fabric and is applied to the carrier by wrapping the fabric along with the epoxy around the skeletal frame. Wrapping creates a plurality of layers which are integrally bonded through the epoxy. After the desired thickness has been obtained, the composite is allowed to cure. When the epoxy has dried, the slots necessary for the straps are cut out of the material.

Preferably, the wrapping occurs transverse the longitudinal axis of the skeletal frame such that top and bottom portions of the carrier are left with flat edges. A preferred embodiment of the invention provides for the formation of top and bottom sections that have rounded edges so as to provide a smooth profile and curvilinear surfaces along the top and bottom of the carrier. These sections are applied in a molding process and consist of a mixture of cut or chopped aromatic polyamide fibers and epoxy. The rounded top and bottom sections eliminate sharp corners.

The top section is further provided with a V-shaped notch which provides a gun rest for situations when the carrier is used to brace or steady a firearm.

The foam back cushion is provided to allow the carrier to conform to the user's back. The profile of the foam cushion approximately coincides with the shape of a user's spine. The foam back cushion relieves discomfort from the backpack when rigorous activity, such as running, is involved.

Preferably, diagonal slots are cut into the foam to reduce heat related discomfort. The slots help dissipate body heat and perspiration. By angling the slots, air flows upwardly and out to the sides. Epoxy adhesive can be used and is preferred to attach the foam to the carrier.

BRIEF DESCRIPTION OF THE DRAWINGS

FIG. 1 is a perspective view of a preferred embodiment of the invention, with the backpack spaced from the carrier.

FIG. 2 is a side view of the embodiment of FIG. 1 with the backpack resting against the carrier.

FIG. 3 is a top view of the preferred metal or metal alloy skeletal frame.

FIG. 4 is an end view of the frame of FIG. 3.

FIG. 5 is a frontal view of the preferred carrier.

FIG. 6 is a side view of the embodiment of FIG. 5.

FIG. 7 is a frontal view of the skeletal frame partially embedded in the fabric covering, with top and bottom portions removed.

FIG. 8 is a cross-sectional view of FIG. 7.

FIG. 9 is a side view of FIG. 7.

DETAILED DESCRIPTION OF THE DRAWINGS

Referring to FIGS. 1 and 2, a backpack carrier 1 supports a backpack 2 by means of straps 4 which are connected to the backpack. The straps 4 pass through slots provided in the carrier 1. Upper and lower straps are adjustably connected so as to allow adjustment of the length of the straps. Preferably, the length of the straps is adjusted to position the foam back cushion 6 to fit the contour of the user's back. The straps, when placed over the user's shoulders as shown in FIG. 2, pull the backpack against a rearward facing surface of the carrier 1 and at the same time pull the carrier and back cushion 6 against the user's back. Significantly, the straps do not directly attach the backpack 2 to the carrier 1. Instead, the straps support the backpack 2 against the carrier 1. Since the carrier 1 can be used and is preferably used as a shield, it is important to provide quick removal of the backpack from the carrier, if desired. One advantage of the invention is that once the adjustable straps are disconnected from each other, the straps can pass through the slots provided in the carrier 1 and the backpack 2 can be easily removed. The upper and lower straps may be adjustably connected by any suitable means which may include belt loops, D-rings, and VELCRO-type fasteners.

Referring also to FIGS. 3 and 4, the carrier 1 has a skeletal support frame 8 which is made of metal or metal alloy, preferably aluminum or titanium. The frame 8 preferably has a number of triangular cut-outs 10 which define diagonal supporting bars 12 which converge from the corners of the frame at approximately the center of the frame. The triangular cut-outs 10 tend to reduce the weight of the frame while the bars 12 ensure stiffness and rigidity of the frame.

The frame 8 is substantially rectangular with parallel side portions 16 and parallel end portions 18. Slots 14 are cut out of the side and end portions to coincide with slots provided in the covering material of the frame. The slots, as previously mentioned, allow for passage of the straps 4.

Holes 20 are provided in frame corner extensions. The holes act as guides for manufacturing.

Referring now to FIGS. 5–9, it can be seen that the frame is embedded in a covering 22 which consists of plural layers of KEVLAR which are wrapped around the frame. The wrappings are preferably around the longitudinal axis of the carrier so as to provide curvilinear sides 24, 26.

Top and bottom portions 28, 30 are formed and attached separately in a molding process in which chopped fiber is used instead of woven and wrapped fiber. The top and bottom portions 28, 30 provide curvilinear surfaces for the top and bottom of the carrier. The overall effect is to provide curvilinear surfaces around all four of the rectangular sides of the carrier. The curvilinear surfaces are better suited for bracing the carrier as a shield. More importantly, the curvilinear surfaces allow the shield to be used as a support for a firearm for steadying the firearm. The surfaces allow for the tilting of the shield with continuous fluid movements, unhampered by sharp corners or square edges which tend to be inherently less stable.

The top portion 28 is provided with a V-shaped notch 32 which receives a firearm when the carrier is used both as a shield and as a support to steady the firearm, thereby increasing the accuracy and effectiveness of the marksman. The notch 32 is cut out of the top portion 28 after the epoxy and chopped fiber have set.

FIGS. 5 and 6 further illustrate the venting effect which is created by angled slots provided in the foam backing. Although FIG. 6 shows a straight line profile for the foam backing, it is preferred that the foam is slightly contoured to the shape of a user's back. However, when soft foam is used, a straight line profile of the foam will conform to the shape of the user's back in use.

The slots 34 are generally parallel and angle upwardly to ventilate the back region of the user, thereby dissipating heat and perspiration. The slots 34 are chevron shaped in the preferred embodiment shown in FIG. 5 and also shown in FIG. 1.

In use, the carrier 1 can be removed from the user's back and laid upon any of its four sides to provide a shield for the user. The notch can be used as a brace or support for a firearm when the notch is on any of four sides, except the bottom. The notch also allows for shielding of the marksman while exposing the barrel for firing. The knapsack may be left on the carrier or it may be removed as previously described. The shield is most effective when the user is in the prone shooting position, i.e., lying on his stomach. However, it may be more desirable to sit behind the shield when the notch is positioned on the top and the shield is used primarily as a gun rest.

While the invention has been described with reference to specific embodiments, modifications or variations of those embodiments are within the scope of the invention, which is defined in the following claims.

I claim:

1. A bulletproof backpack carrier and shield apparatus comprising:

a lightweight skeletal frame having top, bottom, and side edges;

a fiber and epoxy layered covering encasing the skeletal frame, wherein the covering is created by longitudinally wrapping a woven aromatic polyamide fiber fabric around the entire skeletal frame about the side edges forming a plurality of layers, and integrally binding layers with epoxy thereby providing curvilinear sides; and round top and bottom portions attached to the top and bottom edges of the frame and the wrapped fabric to form top and bottom portions of the carrier and shield, wherein the rounded top and bottom portions are made of chopped fiber and epoxy, and wherein the top and bottom portions are epoxied in place.

2. The apparatus of claim 1 wherein the top portion is provided with a V-shaped notch for supporting and bracing a gun barrel.

3. The apparatus of claim 2 further comprising padding connected to a surface of the carrier adjacent a user's back.

4. The apparatus of claim 3 wherein the padding further comprises ventilation means for dissipating heat from the user's body.

5. The apparatus of claim 4 wherein the padding and ventilation means comprise foam padding connected to the carrier and having plural chevron-shaped slots angling upwardly.

6. The apparatus of claim 1 wherein the skeletal frame is generally rectangular in shape and has plural triangular cut-outs forming diagonal bars for reducing weight while maintaining rigidity.

7. The apparatus of claim 6 wherein the frame is made of aluminum.

8. The apparatus of claim 6 wherein the frame is made of titanium.

9. The apparatus of claim 6 wherein the frame is provided with holes in each of four corner portions to facilitate manufacturing.

10. The apparatus of claim 9 wherein the corner extensions are used to secure the top and bottom portions in place.

11. The apparatus of claim 1 further comprising, slots extending through the carrier and shield for receiving straps.

12. The apparatus of claim 11 further comprising, two upper and two lower shoulder straps passing through the slots.

13. The apparatus of claim 12 wherein the straps pass through the slot means and the lower straps are adjustably connected to the upper straps, whereby the backpack is held against the carrier when the user adjusts the straps to fit the carrier against his back.

14. The apparatus of claim 1 wherein the covering is made of KEVLAR.

15. The apparatus of claim 1 wherein the fabric is woven and is made of carbon-based material.

16. The apparatus of claim 1 wherein the top and bottom portions are epoxied in place.

17. The apparatus of claim 3 wherein the padding is connected to the surface of the carrier by an adhesive.

* * * * *